US007600883B2

(12) United States Patent
Deng

(10) Patent No.: US 7,600,883 B2
(45) Date of Patent: Oct. 13, 2009

(54) EXHAUST SYSTEM WITH LIGHT SOURCE

(75) Inventor: Chaohua Deng, Zhongshan (CN)

(73) Assignee: Hanway Technology Co., Ltd., Zhongshan (CN)

( * ) Notice: Subject to any disclaimer, the term of this patent is extended or adjusted under 35 U.S.C. 154(b) by 122 days.

(21) Appl. No.: 11/806,489

(22) Filed: May 31, 2007

(65) Prior Publication Data

US 2008/0298065 A1 Dec. 4, 2008

(30) Foreign Application Priority Data

Apr. 20, 2007 (CN) ..... 2007 2 0050585 U

(51) Int. Cl.
*F21V 33/00* (2006.01)
*F21V 3/00* (2006.01)
*F21V 21/10* (2006.01)
*F24F 13/00* (2006.01)

(52) U.S. Cl. ..... 362/96; 362/311.13; 362/311.14; 362/429; 454/293

(58) Field of Classification Search ..... 362/145, 362/147, 148, 149, 150, 253, 429, 287, 372, 362/373, 364, 96, 580, 576, 355, 294, 330, 362/332, 433, 434, 455, 382, 457, 404, 408, 362/374, 375, 427, 428, 285, 311.14; 454/293
See application file for complete search history.

(56) References Cited

U.S. PATENT DOCUMENTS 4,454,569 A * 6/1984 Maguire ..... 362/127
4,538,217 A * 8/1985 Ewing et al. ..... 362/375
4,681,024 A * 7/1987 Ivey ..... 454/233
4,744,767 A * 5/1988 Henrici et al. ..... 439/226
4,947,297 A * 8/1990 Druffel et al. ..... 362/147
5,820,247 A * 10/1998 Schuler ..... 362/96
5,918,972 A * 7/1999 Van Belle ..... 362/480
5,934,783 A * 8/1999 Yoshikawa ..... 362/96
6,109,766 A * 8/2000 Baliozian ..... 362/287
6,183,116 B1 * 2/2001 Harter et al. ..... 362/368
6,761,463 B2 * 7/2004 Hsu ..... 362/147
7,153,006 B1 * 12/2006 Lin ..... 362/455
7,203,416 B2 * 4/2007 Craw et al. ..... 392/350

* cited by examiner

*Primary Examiner*—Ismael Negron
*Assistant Examiner*—David R Crowe

(57) ABSTRACT

A ventilating exhaust fan including a housing, a light source module, and a panel module, with a conveniently replaceable light source is provided. An added swivel structure between a reflective cover and a lamp socket enables the lamp socket to turn around at certain angles relative to the reflective cover, and when the strip lamp needs to be replaced, it is convenient to pull the strip lamp out by turning the lamp socket that is integrated with the strip lamp, and at the same time the swivel structure enlarges the space between the strip lamp and the reflective cover and makes it easier for an operator to apply force by holding the strip lamp to pull it, and in addition, it can prevent the breakage of the strip lamp, thus eliminating potential harm or injury to the operator.

9 Claims, 4 Drawing Sheets

EXHAUST SYSTEM WITH LIGHT SOURCE

FIELD OF INVENTION

The present invention relates to a ventilating exhaust fan and, in particular, an exhaust fan that also acts as a light source.

BACKGROUND OF THE INVENTION

Typical exhaust fans currently in use include a ventilating exhaust fan housing and a motor module, and an electric motor with coaxially-connected fan blades installed on the panel module of the end face of the housing. This type of ventilating exhaust fan has a sole function of ventilation. At present, there is another type of ventilation exhaust fan which has the dual function of ventilating and lighting, and it adds a light source module between the motor module and the panel module, comprising a reflective cover, a lamp socket that is fixed to the reflective cover, and a strip lamp that is installed in the lamp socket. Because the space between the motor module and the panel module is very small, high wattage incandescent light bulbs can not be installed into this type of exhaust fans due to heat radiation problems. Therefore, smaller wattage light bulbs are installed instead as night lights. When greater light output is needed, some have considered using fluorescent tube energy-saving light bulbs. However, the old energy-saving lamps must be removed from the lamp sockets when replacing the fluorescent tubes, and it is inconvenient to replace fluorescent tubes due to the limited space and the longer length of the fluorescent tubes; fluorescent tubes can be easily shattered and may cause injury when removing them, thus creating more difficulty when installing a new tube.

SUMMARY

The technical problem that the present invention is to solve is to overcome the above mentioned shortcomings by improving the installation structure of the lamp socket to provide a ventilating exhaust fan with a conveniently replaceable light source.

The technical scheme of the present invention is comprised of: a ventilating exhaust fan with a conveniently replaceable light source which includes a ventilating exhaust fan housing, a light source module located within the ventilating housing with a fan, and a panel module, and said light source module includes at least a lamp socket that is used to connect with the light source and a reflective cover which is used to install the lamp socket, and the said lamp socket and the reflective cover have a movable connection.

Said lamp socket and the reflective cover are connected via a lamp cap swivel gantry, among which the lamp cap swivel gantry is articulated with the reflective cover, and the lamp socket is fixed to the lamp cap swivel gantry.

There are axles or apertures located in said lamp cap swivel gantry which are articulated with the reflective cover, and there is a mounting plate for a fixed connection with the lamp socket. In the lamp cap swivel gantry, there is also a safety baffle plate, and said safety baffle plate together with the mounting plate form an L-shaped body, and on both sides of the lamp swivel gantry there are joint plates that are connected with the safety baffle plate and the mounting plate, and one of the plurality of the axles or apertures is located on each of the joint plate.

Said reflective cover is a U-shaped groove structure, and the two side walls of the groove incline outward, and said lamp cap swivel gantry is connected to one end of the reflective cover and the other end of the reflective cover has a sealing plate.

As a further improvement of the present invention, said panel module includes a panel support member, a panel main body and a movable connection fitting that can be horizontally moved to position the panel main body onto the panel support member; and said panel support member has a fixed connection with the ventilating exhaust fan housing-house, and the panel garnish member and the panel support member are connected to form an integrative part.

Said movable connection fitting comprises several keyholes that are formed by slots and round apertures located in the panel support member, and a connection member located in the panel garnish member, and all keyholes have the same orientation, and there is a shoulder that fits into the keyhole located in said connecting member, and the shoulder is inserted into the keyhole via the round aperture and locked in the slot of the keyhole. The other end of connecting member is threaded, and through the threaded end of the connecting member the panel garnish member is connected with the panel main body to form an integrative part.

There is a position step located in the middle of the connecting member, and the distance between said position step and the shoulder equals or is slightly greater than that of the thickness of the panel support member at the keyhole, the diameter of the position step is greater than the diameter of the round aperture of the keyhole.

Because of the adoption of the above mentioned technical scheme, the present invention has the following beneficial effects: an added swivel structure between the reflective cover and lamp socket enables the lamp socket to turn around at certain angles relative to the reflective cover, and when the strip lamp needs to be replaced, it is convenient to pull the strip lamp out by turning the lamp socket that is integrated with the strip lamp, and at the same time the swivel structure enlarges the space between the strip lamp and the reflective cover and makes it easier for an operator to apply force by holding the strip lamp to pull it, and in addition, it is unlikely that the strip lamp will bump against the end face of the reflective cover, and it can prevent the breakage of the strip lamp, thus eliminating potential harm or injury to the operator.

Furthermore, because of the special structural design of the panel module, the panel module of the ventilating exhaust fan can be easily removed by moving the panel main body horizontally along the keyhole and conveniently replace the strip lamp as needed. This structural design not only can be used with popular partite plastic panels, it can also be used with heavier materials such as glass and ceramics.

DESCRIPTION OF THE DRAWINGS

The following are the drawing and examples of practice to further describe a ventilating exhaust fan with conveniently replaceable light source of the present invention.

DETAILED DESCRIPTION OF THE INVENTION

Figure 11:
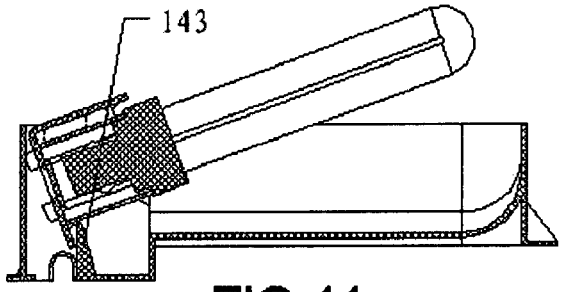
FIG. 11 is a perspective view of FIG. 3.

As shown in FIG. 1 to FIG. 5 the present invention of an ventilating exhaust system with conveniently replaceable light source comprises a ventilating exhaust fan housing 1, a motor module 2 within the ventilating exhaust fan housing 1 with a fan 7, a light source module A and a panel module B, and the light source module A includes 1 to 2 lamp sockets 16 that are used to connect energy-saving lamps 17, a corresponding lamp cap swivel gantry 15 and a reflective cover 14, and the energy-saving lamp 17 is clipped into the lamp socket 16. The lamp cap swivel gantry 15 comprises a mounting plate 151 and a safety baffle plate 152 that forms an L-shape with the mounting plate 151, and at the two sides lamp cap swivel gantry 15 there is a joint plate 153 that is connected with the safety baffle plate 152 and the mounting plate 151, and in the joint plate 153 there is an aperture 156 to be used to articulate the joint plate with the reflective cover 14. The lamp socket 16 is fixed by bolts to the mounting plate 151 of the lamp cap swivel gantry 15, and the lamp cap swivel gantry 15 is articulated with the reflective cover 14 via the connecting axis 11 that goes through the aperture 156, and a rectifier 13 is installed under the reflective cover 14. The reflective cover 14 is a U-shaped groove structure with its two side walls of the groove inclining outward, and the lamp cap swivel gantry 15 is articulated with one end of the U-shaped groove and the other end has a sealing plate 141. Because a check block is designed to locate at the bottom of the reflective cover 14, the turning of the lamp socket 16 is limited to certain angles, as shown in FIG. 11. Because the lamp cap swivel gantry 15 can turn freely, a position opening or position aperture may be made in the safety baffle plate 152 to lock the strip lamp into the position within the U-shaped groove after installation of the energy-saving lamp 17, and a connecting column that is internally threaded can be designed to locate at the position of the reflective cover corresponding to the position opening, and the lamp cap swivel gantry 15 and the connecting column can be connected through bolts (not shown in the drawing). Or a hook 154 can be designed to locate at the bottom of the safety baffle plate 152 of the lamp cap swivel gantry 15, and a snap 142 can be designed at the corresponding position of the reflective cover, so that the lamp cap swivel gantry 15 and the reflective cover can be clipped to lock into their positions. When the energy-saving lamp 17 needs to be replaced, the bolt at the position opening can be pulled out, or apply external force to make the hook 154 slip off the snap 142, thus allowing the energy-saving lamp 17, the lamp socket 16 and the lamp cap swivel gantry 15 to turn together at a certain angle, so that the strip lamp can be pulled out easily without knocking against the sealing plate 141 at the other end of the reflective cover 14 thus avoiding shattering the strip lamp, and eliminating harms and injuries to the operator. In addition, the turning of the strip lamp 17 to a certain angle enlarges the space between the strip lamp 17 and the reflective cover and makes it easier for a user to put his hand inside the reflective cover to apply force by holding the strip lamp to pull it out or install it. Said reflective cover 14 is fixed in the motor support plate 8 of the motor module 2. After electro-cladding process of the internal surface of the reflective cover, the reflective intensity may be increased, and the inclined U-shaped design of the reflective cover 14 enables a larger space, a greater reflective area and better reflective effect.

Figure 9:
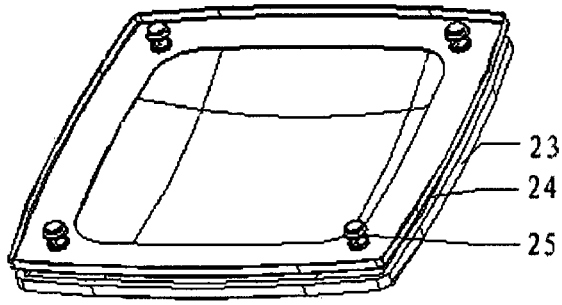
FIG. 9 is a three-dimensional drawing of the installed connecting bolt, panel garnish member and panel main body of FIG. 6.
Figure 10:
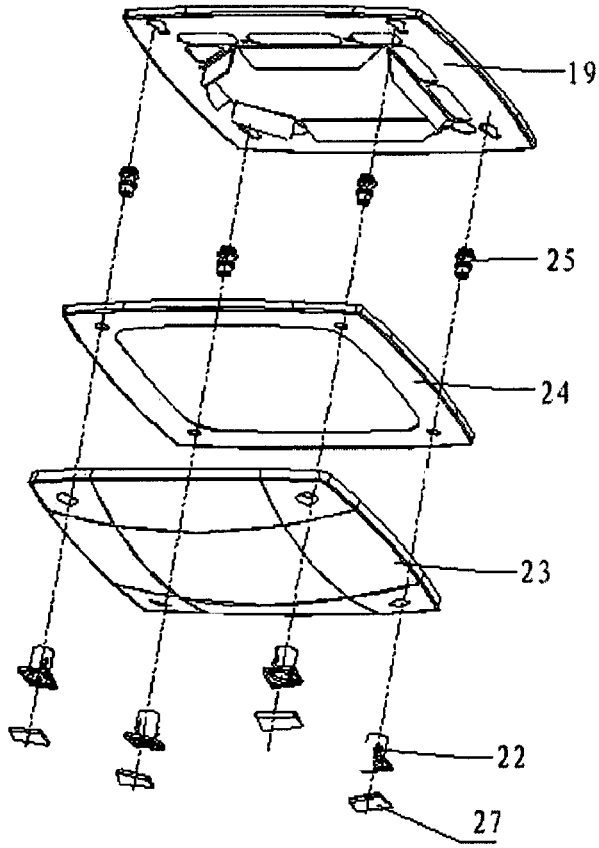
FIG. 10 is a breakdown drawing of FIG. 6.

The keyhole 191 comprises slots and round apertures located at the four corners of the panel support member 19, and all keyholes 191 have the same orientation. The connecting bolt 25 is a column structure, and one end of the connecting bolt has an internal thread 252, and the screw 26 goes through the bush 22 to fasten with the internal thread 252, thus to connect the panel garnish member 24 with the panel main body 23 to form an integrative body. As shown in FIG. 9, the design of the bush 22 takes into consideration the limitation of glass and similar materials processing for the panel main body, and because holes in glass products can not be made with a high level of precision, it may therefore use plastic material to make the bush 22 and then put the garnish cover 27 over it.

Figure 1:
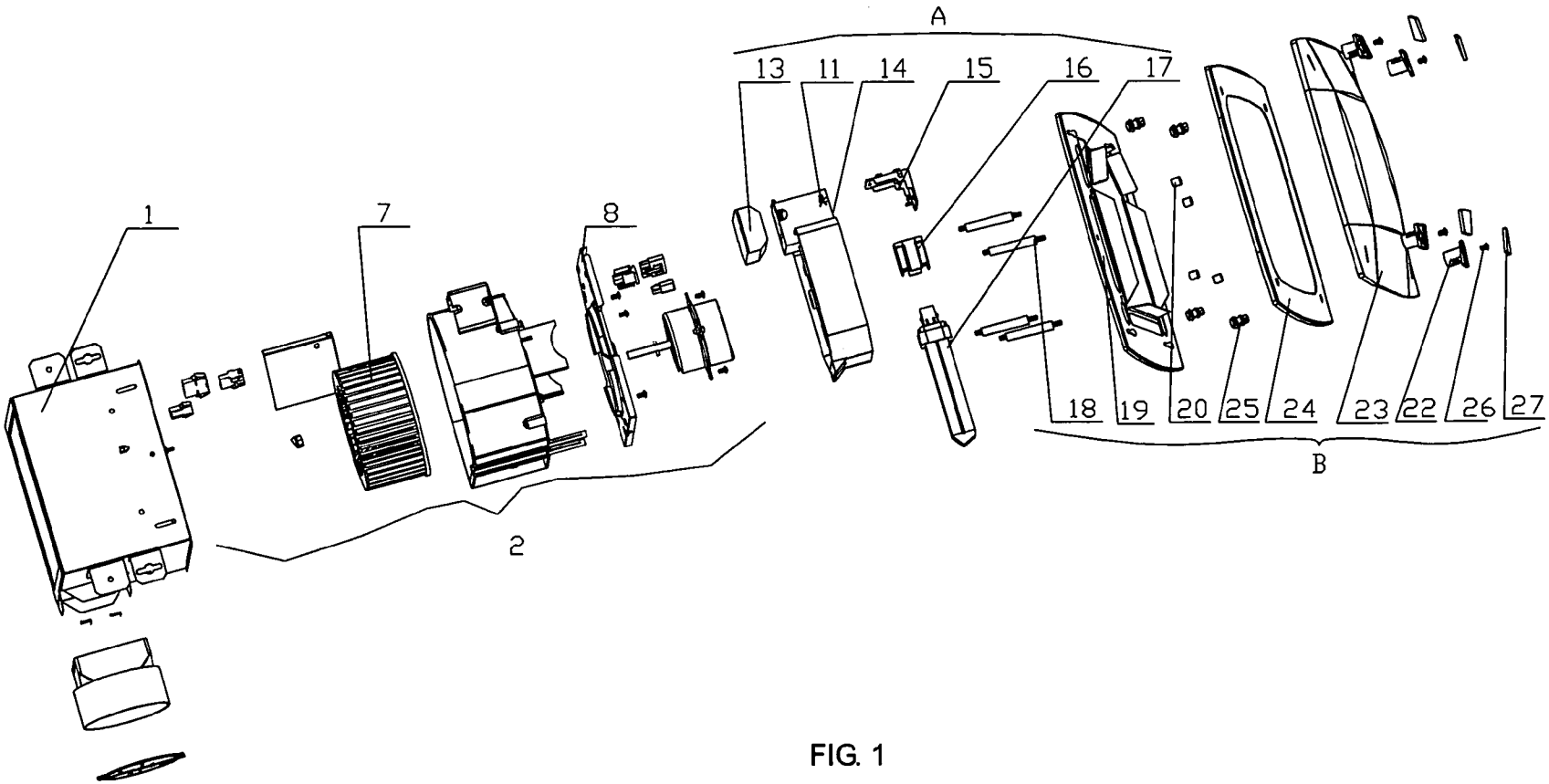
FIG. 1 is an axonometric drawing of a ventilating exhaust fan with conveniently replaceable light source of the present invention.
Figure 2:
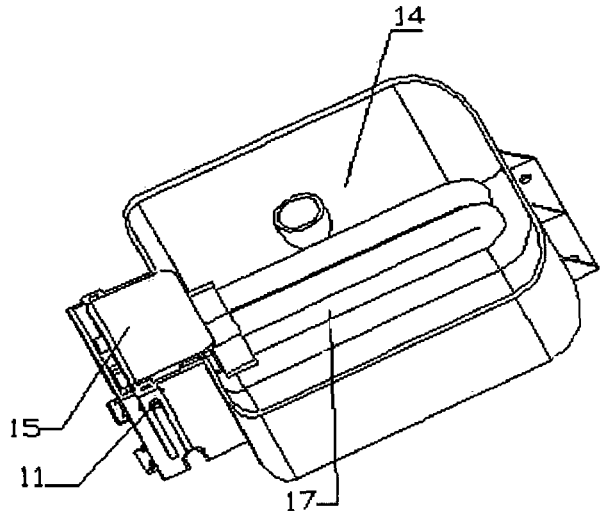
FIG. 2 is a three-dimensional drawing of the installed reflective cover, lamp socket and strip lamp of FIG. 1.
Figure 3:
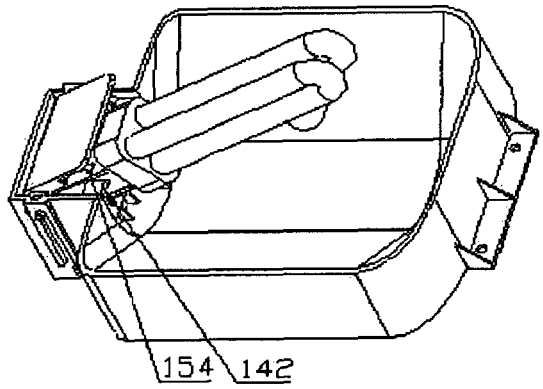
FIG. 3 is a three-dimensional drawing of the lamp socket within FIG. 2 after it is swiveled.
Figure 4:
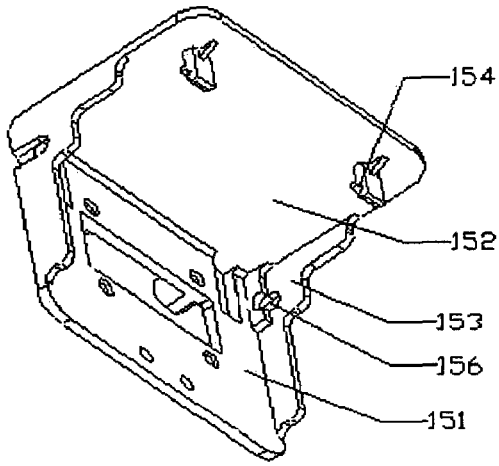
FIG. 4 is a three-dimensional drawing of the lamp cap swivel gantry of FIG. 3.
Figure 5:
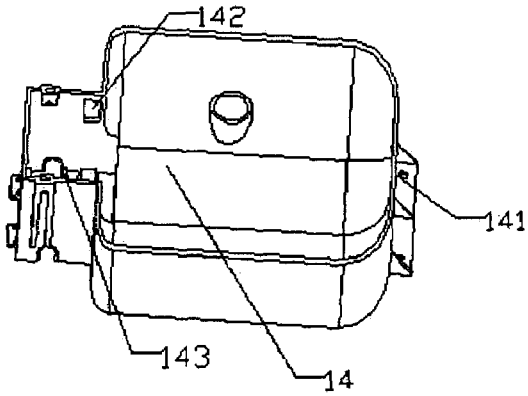
FIG. 5 is a three-dimensional drawing of the reflective cover of FIG. 3.
Figure 6:
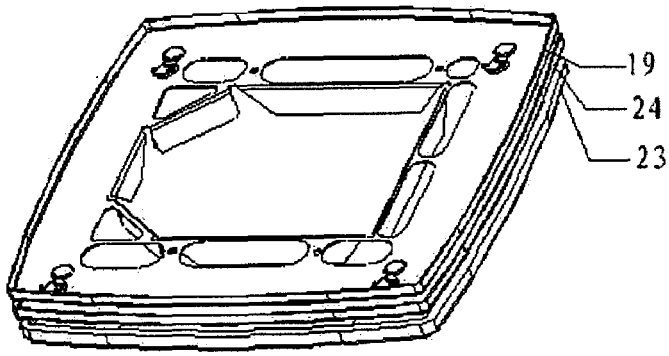
FIG. 6 is a three-dimensional drawing of the panel module.
Figure 7:
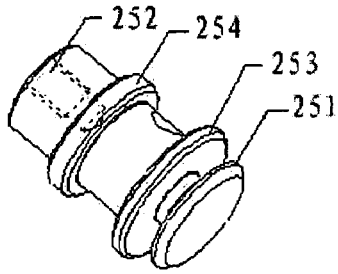
FIG. 7 is a three-dimensional drawing of the connecting bolt of FIG. 6.
Figure 8:
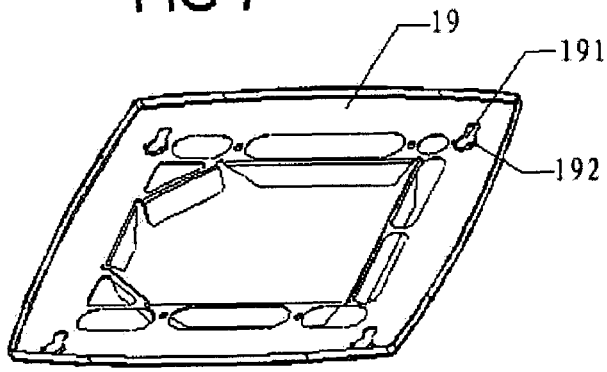
FIG. 8 is a three-dimensional drawing of the panel support member of FIG. 6.

As shown in FIG. 7, the other end of the connecting bolt 25 has the shoulder 251 that can fit with the keyhole 191, and there is also position steps 253, 254 located between the shoulder 251 and the screw thread 252 and the steps share the same axis with the shoulder 251, and the distance between the position step 253 and the shoulder 251 is equal to or slightly greater than the thickness of the panel support member 19 at the keyhole 191, the diameter of the position step 253 is larger than the diameter of the round aperture of the keyhole 191. The main function of the position step 254 is to lock the axial position of the connecting bolt at the panel garnish plate 24.

During installation, the shoulder 251 of the connecting bolt 25 first goes through the round aperture of the keyhole 191 and it then moves horizontally along the direction of the slot, thus to lock the connecting bolt 25 into the slot of the keyhole 191. Such a structural design particularly fits the panel main body 23 made of glass or ceramic. It is because this type of panel main body has greater weight and it can not use the snap device to clip it into position quickly as the panel main body made of plastic material. Therefore, by employing above mentioned connecting method, the panel main body 23 made of glass and ceramic and other materials can be conveniently and quickly connected with the housing 1 to form an integrative body.

Furthermore, there is a check block 192 along the edge of the round aperture located behind the keyhole 191 of the panel support member 19, the check block 192 has the same radian as that of the round aperture; and its main function is, when the panel main body 23 is moved horizontally and once the shoulder 251 runs into the check block 192, the panel main body 23 can be removed axially along the round aperture with no need for the operator to pinpoint at the center of the round aperture. At the same time, the position steps 253, 254 in the connecting bolt 25 ensure a constant clearance between the panel main body 23, the panel garnish member 24 and the panel support member 19, providing favorable conditions for cooling the lamp 17.

What we claim is:

1. A ventilating exhaust fan system comprises:

a ventilating exhaust fan housing with a fan;

a light source module mounted within the ventilating exhaust fan housing, including at least a lamp socket that is used to connect with the light source and a reflective cover that is used for installation of the lamp socket, and the lamp socket has a movable connection with the reflective cover;

a panel module comprising a panel support member, a panel garnish member, a panel main body and a movable connection fitting that can be horizontally moved to position the panel main body onto the panel support member;

a lamp cap swivel gantry to which the lamp socket and the reflective cover are connected, and the lamp cap swivel gantry has a plurality of axles or apertures that are used to articulate with the reflective cover and a mounting plate for securing the lamp socket, and the lamp socket is fixed to the lamp cap swivel gantry;

said panel support member has a fixed connection with the ventilating exhaust fan housing, and the panel garnish member and the panel support member are connected to form an integrative part;

the lamp cap swivel gantry further comprises a safety baffle plate, which, together with the mounting plate, form an L-shaped body; and a joint plate on both sides of the lamp cap swivel gantry to connect the safety baffle plate and the mounting plate, and one of the plurality of axles or apertures are located on each of the joint plate.

2. The ventilating exhaust fan system as claimed in claim 1, wherein the reflective cover is a U-shape groove structure, the two side walls of the groove incline outward, and the lamp cap swivel gantry is connected to one end of the reflective cover and the other end of the reflective cover has a sealing plate.

3. The ventilating exhaust fan system as claimed in claim 1, wherein the movable connection fitting comprises several keyholes that are formed by slots and round apertures located in the panel support member, and a connection member located in the panel garnish member.

4. The ventilating exhaust fan system as claimed in claim 3, wherein all the keyholes have the same orientation, and there is a shoulder that fits into the keyhole which is axially disposed on the connection member, and the shoulder is inserted into the keyhole via the round aperture and locked into the slot of the keyhole.

5. The ventilating exhaust fan system as claimed in claim 4, wherein one end of the connecting bolt is threaded, and through the threaded end of the connecting member, the panel garnish member is connected with the panel main body to form an integrative part.

6. The ventilating exhaust fan system as claimed in claim 5 further comprises a position step located in the middle of the connecting member, and the distance between the position step and the shoulder is equal to or slightly greater than that of the thickness of the panel support member at the keyhole, the diameter of the position step is greater than the diameter of the round aperture of the keyhole.

7. The ventilating exhaust fan system as claimed in claim 6, wherein the panel main body is made of glass or ceramic or other materials.

8. The ventilating exhaust fan system as claimed in claim 6, further comprises a check block along the edge of the round aperture located behind the keyhole of the panel support member; and the check block has the same radian as that of the round aperture.

9. The ventilating exhaust fan system as claimed in claim 8, wherein the panel main body can be removed axially along the round aperture when the panel main body is moved horizontally and once the shoulder runs into the check block.

* * * * *